US005528798A

United States Patent [19]

Strobel et al.

[11] Patent Number: 5,528,798

[45] Date of Patent: Jun. 25, 1996

[54] DRAW FRAME AND PROCESS FOR THE OPERATION OF A DRAW FRAME RESPONSIVE TO SILVER SENSING

[75] Inventors: Michael Strobel, Eichstätt; Dieter Werner, Göppingen; Kumara De Silva, Göppingen; Wolfgang Jaeger, Göppingen, all of Germany

[73] Assignee: Rieter Ingolstadt Spinnereimaschinenbau AG, Ingolstadt, Germany

[21] Appl. No.: 441,472

[22] Filed: May 15, 1995

[30] Foreign Application Priority Data

Jul. 12, 1994 [DE] Germany ..... 44 24 490.8

[51] Int. Cl.[6] ..... D01H 5/38; D01G 23/00

[52] U.S. Cl. ..... 19/240; 19/0.25; 19/236; 19/239

[58] Field of Search ..... 19/0.20, 0.25, 19/0.26, 236, 237, 239, 240, 241

[56] References Cited

U.S. PATENT DOCUMENTS

| | | | |
|---|---|---|---|
| 3,300,817 | 1/1967 | Binder et al. . | |
| 4,163,927 | 8/1979 | Grice, Jr. | 19/240 X |
| 4,404,710 | 9/1983 | Wood | 19/240 X |
| 4,779,311 | 10/1988 | Leifeld | 19/240 X |
| 5,023,976 | 6/1991 | Meyer et al. | 19/0.25 |
| 5,086,542 | 2/1992 | Franklin et al. | 19/0.25 |
| 5,398,380 | 3/1995 | Leifeld . | |

FOREIGN PATENT DOCUMENTS

| | | | |
|---|---|---|---|
| 1510481 | 7/1970 | Germany . | |
| 387793 | 3/1989 | Germany . | |
| 1341261 | 9/1987 | U.S.S.R. | 19/0.25 |

OTHER PUBLICATIONS

Article–Einfuhrung In Die Regelungstechnik II, Textilindustrie 71, Apr. 1969.

Article–Allgemeine Grundlagen Der Steuerung Und Regelung, Melliand Textilberichte, Jul. 1963.

*Primary Examiner*—John J. Calvert

*Attorney, Agent, or Firm*—Dority & Manning

[57] ABSTRACT

A process for controlling the operation of a textile draw frame wherein a plurality of fiber slivers are fed to the draw frame at a predetermined desired delivery speed includes monitoring the presence of individual fiber slivers delivered to the draw frame and decreasing the delivery speed of the draw frame if any of the monitored fiber slivers is indicated as missing from being fed to the draw frame. The process includes subsequently increasing the delivery speed of the draw frame if the respective missing fiber slivers are again indicated as being fed to the draw frame. The invention also includes a draw frame including apparatus for carrying out the controlling process.

26 Claims, 4 Drawing Sheets

DRAW FRAME AND PROCESS FOR THE OPERATION OF A DRAW FRAME RESPONSIVE TO SILVER SENSING

BACKGROUND OF THE INVENTION

The present invention relates to a draw frame and to a process for the operation of a draw frame in processing a plurality of fiber slivers produced in carders and fed to the draw frame.

Autolevellers such as the RSB 851 of the firm Rieter Ingolstadt with drafting equipment including draw-in and delivery rollers, a main motor and a variable-speed motor are known in the art. The variable-speed motor is superimposed on the main motor with respect to the rotational speed of the draw-in rollers of the draw frame. The main motor, in addition to driving the draw-in rollers, is in particular used to drive the delivery rollers and thereby determines the delivery speed of the drafting equipment. If it is found by means of a measuring system, by means of which the thickness of the entering fiber slivers is measured, that the measured thickness deviates from a pre-set desired value, the draw-in speed of the fiber sliver is accelerated or reduced by means of the variable-speed motor. The delivery speed on the other hand remains always constant. This system ensures constant delivery speed independently of the levelling function. The draw-in speed of the fiber sliver is on the other hand constantly changed. In case of breakage of a presented fiber sliver, the system reacts as it would in case of an extremely think sliver presentation, i.e. the draw-in speed of the remaining slivers is increased. If, in addition, there are also thin spots in the remaining slivers, levelling may sometimes not adhere exactly to the desired value of the drafted fiber sliver. In feeding of fiber slivers without cans from several carders to the draw frame, the requirement of fiber slivers is furthermore so great in case of breakage of a fiber sliver that the carders are unable to present the needed fiber slivers in spite of maximum delivery. Also, intercalated sliver stores are used up within a short time, so that the draw frame must be switched off after the short time. Where slivers are fed by means of cans, the time between the can replacements is also clearly shortened, so that more operator intervention is needed here.

Spinning lines consisting of a carder and a downstream draw frame are known from DE-OS 15 10 481. Between carder and draw frame, a storage is provided which equalizes differences in delivery from the carder to meet the fiber sliver requirement of the draw frame. It is a disadvantage in such a system that when the carder stops, the sliver storage is very quickly exhausted. The draw frame therefore receives no more fiber sliver material for further processing and therefore also stops. Since the draw frame does not contain any levelling device, the adherence to a required fiber sliver thickness is furthermore not possible when a fiber sliver is missing at the intake.

An installation consisting of a draw frame and several upstream carders is known from CH-PS 400 855. The fiber slivers produced in the carders are fed to the draw frame by means of a conveyor belt. Between carder and conveyor belt is a sliver storage in order to equalize differences between carder delivery and draw frame requirement. Thanks to the assignment of several carders to one draw frame, the reserve of fiber sliver available to the draw frame is greater, but still not sufficient for modern, very rapidly working draw frames.

It is therefore also a disadvantage in this system that when the carder is stopped, and following the consumption of the fiber sliver stored in the intercalated fiber storage, the draw frame is also quickly running out of material for further processing and must therefore be stopped. In this case it is also not an autoleveller.

OBJECTS AND SUMMARY OF THE INVENTION

It is a principal object of the instant invention therefore to maintain the production of a draw frame in spite of a missing fiber sliver and to continue producing a fiber sliver of high quality in the draw frame. Additional objects and advantages of the invention will be set forth in part in the following description, or may be obvious from the description, or may be learned through practice of the invention.

The instant invention attains the objects in that the delivery speed of the draw frame is lowered when a fiber sliver is missing. Thereby the draw-in speed of the fiber slivers into the draw frame is not increased to such an extent as would have to be the case if the delivery speed remained unchanged. As soon as the fiber sliver is again conveyed to the draw frame, the delivery speed of the draw frame is again accelerated to the original value. It is an advantage of the invention that the fiber sliver reserve for the draw frame is exhausted more slowly than in normal operation at higher draw-in speeds. Premature intervention into the fiber presentation, if effected in cans, or stoppage of the cards preceding the draw frame are thus avoided in case of fiber presentation without cans.

The delivery speed is advantageously increased with a time delay relative to the resumed feeding of the fiber sliver. This takes into the account the fact that during the time needed by the fiber sliver to go from the feeding device into the draw frame, the delivery speed of the draw frame is adapted to the reduced sliver presentation, and only when the new fiber sliver is in the draw frame is the delivery speed accelerated again to the original delivery speed. It is therefore of special advantage if the time delay is selected as a function of the interval in the feeding of the missing sliver. This means that the time delay is greater if the feeding point of the new fiber sliver is further away from the draw frame than in case of a closer feeding point.

If the delivery speed of the draw frame is lowered by a percentile amount which represents essentially the share of missing fiber sliver within the totality of fiber slivers presented to the draw frame, the draw-in speed of the remaining fiber slivers remains substantially constant. In an autoleveller, the draw-in speed of the fiber slivers is reduced in principle by lowering the delivery speed. But in order to produce the desired fiber sliver in the draw frame, the levelling motor adapts the draw-in speed again to the required fiber quantity per time unit in case of a missing fiber sliver. This means that the delivery speed of the draw frame is reduced, but that the draw-in speed is however increased due to the missing fiber sliver to such extent that it is equal to the original draw-in speed per fiber sliver by comparison with the higher delivery speed. In this manner a withdrawal from the remaining fiber slivers such as in normal production is achieved. The upstream can or carder therefore puts the fiber sliver at disposal as in normal drafting. The missing of a fiber sliver does mot affect the other fiber slivers or the equipment. If the fiber sliver produced is produced at three quarters of its original delivery speed for example,only three quarters of the fiber sliver to be drawn in is needed. Since in this case however one of four slivers (25%) is missing for example, the remaining three slivers must make more fiber material available per time unit. The draw-in speed of the remaining fiber slivers is thus reduced by 25% on the one hand, but is on the other hand increased again by 25% in order to meet the increased fiber sliver requirement. The consumption of fiber slivers on the upstream elements, a can or e.g. a carder, is thus essentially equal to the consumption during normal operation. The operator functions, such as for example can replacement, must therefore be carried out at the same time intervals as in normal operation. If carders are installed upstream of the draw frame, these can continue to produce essentially at the same speed, and a stoppage of the carder need not be feared.

If the draw frame is switched off in the case that another sliver is missing, this prevents a fiber sliver of insufficient thickness from leaving the draw frame. This applies in particular in the case of a presentation of a total of 4 fiber slivers, where the missing of 2 slivers would mean a production shortfall of 50%. In this case it is more economical to switch off the draw frame.

If the fiber sliver is fed to the draw frame without cans, it is advantageous for the band to be fed between carder and draw frame to a sliver storage and/or to a conveying device. This creates a buffer in which the carder can produce even when the draw frame is stopped or produces with little delivery or low draw-in speed. In case of longer stoppage of the draw frame or lower fiber requirement over a longer period of time, it is advantageous if the delivery speed of the carder is reduced as soon as the sliver storage has reached a given full state. If sliver storage is not emptied gradually in spite of the reduction of the delivery speed of the carder, the delivery of the carder is further reduced. This prevents the sliver storage from becoming too full so as to cause malfunctions. Only if this action does not cause the sliver storage to be emptied is the delivery of the carder stopped.

Further reduction, to one fifth of the desired-value delivery speed has been proven to be advantageous if the draw frame experiences a longer malfunction or interruption of its production and the sliver storage is however not yet full.

If the sliver storage is emptied beyond a predetermined degree, the delivery speed of the carder is advantageously increased so as not to endanger the production of the draw frame. This causes the sliver storage to always contain a certain amount of fiber sliver in order to supply the draw frame with fiber sliver on the one hand, and on the other hand so as to allow the carder to also operate productively. For the carder, it is especially advantageous to adapt the delivery to the prevailing conditions in the sliver storage, as a stoppage of the carder presents problems with respect to productivity and precision of the fiber sliver. A deviation of plus/minus 10% from the desired-value delivery speed has proven to be an advantageous change in delivery speed. In this manner the fluctuation caused by a varying withdrawal speed of the fiber sliver from the sliver storage is equalized by the draw frame.

An autoleveller according to the invention is provided with a sensor in the area of fiber feeding in order to register a fiber sliver. By means of this sensor, it is possible to ascertain whether a fiber sliver is available to be presented at the draw frame. Depending on the type of sensor, either the missing of a fiber sliver is recorded, or it is inferred from the stoppage of a fiber sliver that the fiber sliver has been torn between sensor and draw frame. This sensor is connected via an electronic system to the drive of the draw frame and, in the case of fiber sliver breakage, causes the delivery speed of the draw frame to be reduced. Although the productivity of the draw frame is reduced thereby, the overall system of carder or can and draw frame continues to be operated advantageously, since maintenance intervals on the drafting equipment and the productivity of the card are not influenced.

A sensor is advantageously associated with each fiber sliver in order to ascertain which fiber sliver has been torn. The drive of the draw frame is decelerated or accelerated when the fiber sliver is again present by means of a frequency converter influenced by the sensor. It is possible to influence a timely drafting between fiber sliver feed and actual presence of the fiber sliver in the drafting frame by means of a time delay element installed between sensor and frequency converter. In this manner the draw frame is accelerated again to its delivery speed only when all the fiber slivers are in the draw frame.

A conveyor belt for the feeding of fiber sliver is advantageously installed before the draw frame. The sensor used to detect a fiber sliver breakage is located in the area in which the fiber sliver is fed on the conveyor belt. This makes it possible to detect a fiber sliver breakage rapidly. Even if a fiber sliver tears between sensor and draw frame, a signal is obtained from the immobilized fiber sliver, indicating the fiber sliver breakage. The delivery speed of the draw frame is advantageously reduced by this signal.

A carder is provided before the draw frame for continuous fiber sliver feed. The fiber sliver is fed to the draw frame directly, without cans. In this manner, supply of the draw frame without expensive conveying of the fiber sliver is made possible. The fiber sliver is treated with care and is processed in the draw frame immediately following the processing in the carder. In order to be able to compensate for disturbances in the carder production, a fiber sliver storage is advantageously provided between the draw frame and the carder. Thereby short interruptions in carder production or changes in fiber sliver requirement at the draw frame can be bridged for brief periods of time. The state of fullness of the fiber sliver storage is detected by means of a sensor on the fiber sliver storage. The state of fullness is controlling for the production of the carder. Therefore the sensor is connected to the controls of the delivery speed of the carder. The sensor is able to react to the weight of the fiber sliver which is present in the fiber sliver storage, or may ascertain the level of fullness of the sliver storage and thereby transmit signals to the controls of the carder. The sensors are adjusted advantageously so that the state of fullness is recognized in good time in order to allow for a reaction of the carder. Thus, sufficient room must remain in the sliver storage when ascertaining an upper state of fullness in order to be able to accept fiber sliver until the carder's delivery has been reduced sufficiently so that the contents of the fiber sliver storage can be expected to be reduced again with a lower state of fullness of the fiber sliver storage, a sufficient amount of fiber sliver must remain in the storage so that as production of the card increases slowly, it will be possible to still take fiber sliver from the sliver storage without tearing the fiber sliver.

DETAILED DESCRIPTION OF THE PREFERRED EMBODIMENTS

Figure 1:
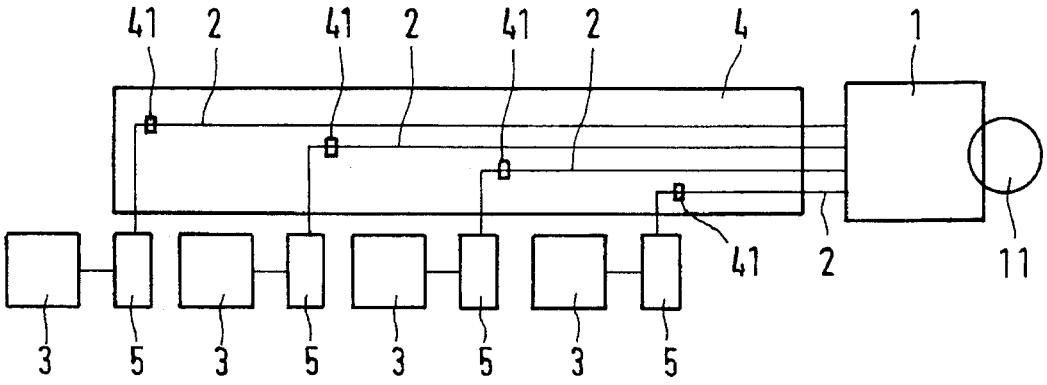
FIG. 1 shows an arrangement of a fiber feed without cans.

Reference will now be made in detail to the presently preferred embodiments of the invention, one or more examples of which are illustrated in the drawings. Each example is provided by way of explanation of the invention, and not as a limitation of the invention.

In FIG. 1 an arrangement of a fiber feed without cans from a carder 3 to a draw frame 1 is shown. In the shown embodiment four carders 3 are assigned to a conveyor belt 4. Each carder 3 is provided with a sliver storage 5 in which the fiber sliver 2 is put in intermediate storage. The fiber sliver 2 is guided via a sensor 41 from the sliver storage 5 to the conveyor belt 4. The sensors 41 have an active connection to the draw frame 1 which is not shown. In the draw frame 1, the arriving fiber slivers 2 are evened out and drafted, and are then deposited in a can 11. The reduction of the delivery speed of the draw frame according to the invention, i.e. the transfer of fiber sliver into the can 11 takes place as soon as a signal is transmitted by one of the sensors 41 to the draw frame 1, indicating that one of the fiber slivers 2 has been torn. The sensor 41 advantageously recognizes a fiber sliver breakage from the fact that either the fiber sliver is no longer present in the sensor 41, or that it no longer moves. Capacitative sensors make such movement signals possible. As a result those fiber sliver breakages which occur between the sensor 41 and the draw frame 1 are also detected. The fiber sliver end towards the draw frame 1 continues to be drawn into the draw frame 1, while the fiber sliver end away from the draw frame 1 remains in place. The sensor 41 recognizes this fiber sliver end which no longer moves and signals this to the draw frame 1. The delivery speed of the draw frame i is then reduced.

In an advantageous embodiment of the invention, the reduction speed is reduced by the percentile amount corresponding substantially to the share of missing fiber sliver 2 within the totality of fiber slivers 2 presented to the draw frame 1. In the present example in which four fiber slivers 2 are presented, the absence of one fiber sliver 2 amounts to one fourth of the totality of fiber slivers. The reduction of the delivery speed of the draw frame 1 is therefore 25%. The delivery speed of the draw frame 1 amounts therefore to 75% of the original desired delivery. This reduced delivery speed continues until the sensor 41 signals that the fiber sliver 2 is again present or in motion. The delivery speed of the draw frame 1 is then again accelerated to 100% of the desired delivery. In an advantageous embodiment of the invention, the acceleration of the delivery speed begins after a time delay. This time delay depends on the distance between the sensor 41 and the draw frame 1. In the case of fiber sliver breakage at the sensor 41 closest to the draw frame, the time until the repaired fiber sliver 2 is again available to the draw frame 1 is relatively short. This means that the time delay for resumed acceleration of the delivery of the draw frame 1 is shorter than for the more distant sensors 41. The time delay can be ascertained theoretically by calculating the speed of the conveyor belt 4 and the distance between the sensor 41 and the draw frame. At the end of the time delay, all of the fiber slivers 2 of the draw frame 1 are again available.

In the case that during the time of a fiber sliver breakage another fiber sliver 2 should tear, provisions are made, at least for the present embodiment with four fiber slivers, that the draw frame 1 is switched off. The two remaining fiber slivers may not be sufficient in draw frame 1 for a sufficient mixing of the fiber material and for drafting. The quality of the fiber sliver deposited in can 11 would thus be affected. It is therefore better to stop the delivery of draw frame 1 completely. If more than four fiber slivers 2 are being fed to the draw frame 1 however, it may still be advantageous, in case of failure of two fiber slivers, to reduce the delivery of the draw frame 1 by the percentile amount of a fiber sliver versus the totality of all fiber slivers. If six fiber slivers are presented, this would mean that in case that two fiber slivers 2 are missing, the delivery of the draw frame 1 is reduced by one third of its desired delivery.

In the case of two or more missing fiber slivers the delivery of the draw frame is accelerated again in steps after the repair of the fiber sliver. This means that in case of two torn fiber slivers 2, first one fiber sliver 2 is repaired and placed on the conveyor belt 4, and the draw frame 1 is thereby accelerated, possibly with time delay, to 75% of its delivery. When the second torn fiber sliver 2 has also been repaired and has been placed on the conveyor belt 4, the draw frame 1 is accelerated to 100% of delivery, again with a possible time delay. This allows for optimal operation of the draw frame 1.

Figure 2:
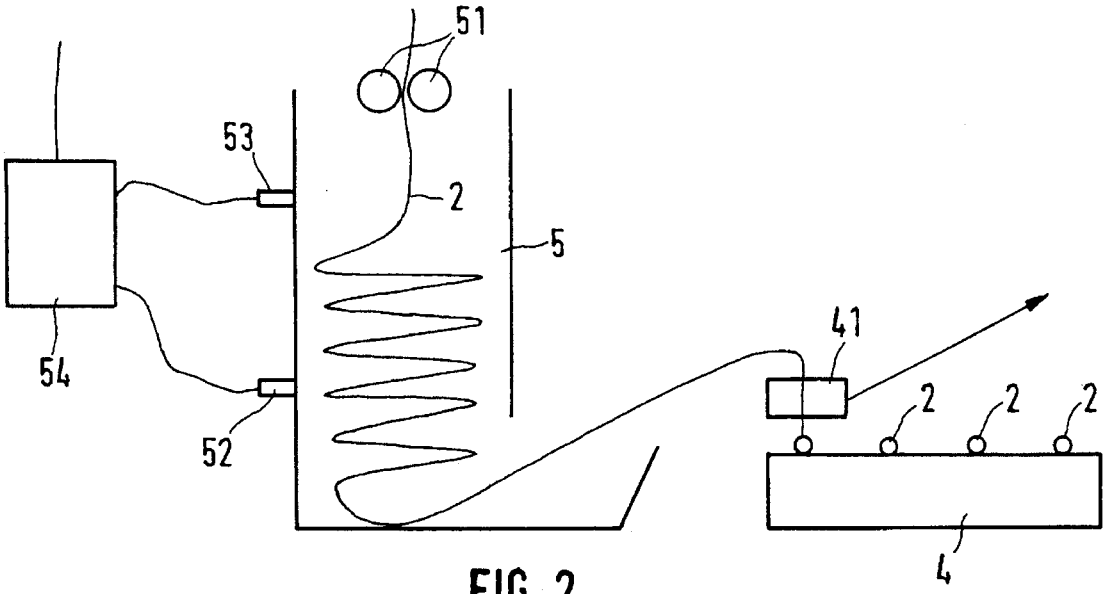
FIG. 2 shows the sliver storage of a carder.

FIG. 2 shows a sliver storage 5 of a carder 3. The fiber sliver 2 is fed by means of delivery rollers 51 into the sliver storage 5 in the form of loops. On the underside of the sliver storage 5 a discharge opening for the fiber sliver 2 is provided. The fiber sliver 2 is conveyed from this discharge opening to the sensor 41 and is then placed on the conveyor belt 4. In FIG. 2 three additional fiber slivers 2 are placed on the conveyor belt 4 and are conveyed in the direction of the draw frame 1. The sensor 41 is connected via a data circuit to the controls of draw frame 1 which are not shown.

Sensors 52 and 53 are installed on the sliver storage 5. The lower sensor 52 transmits a signal to the controls 54 of the carder 3 as soon as the stored fiber sliver 2 in the sliver storage 5 is at a lower level than the distance between the lower sensor 52 and the bottom of the sliver storage 5. In order to prevent complete emptying of the sliver storage 5 and thereby possible breakage of the fiber sliver, the delivery of carder 3 is increased via controls 54. Thereby, the state of fullness of the sliver storage 5 is increased again, and a sufficient reserve of fiber sliver is available for further processing on the draw frame 1. As soon as the state of fullness reaches the level of sensor 53, a signal is transmitted to the controls 54 of the carder 3, causing the delivery of the carder 3 to be reduced. A reduction by approximately 10% of the desired delivery of the carder has proven to be advantageous. In this manner a drastic reduction of the delivery speed and of the amount of fiber sliver being delivered is effected. If even this action does not reduce the fullness level of the fiber sliver in the sliver storage 5 to below the sensor 53, the delivery of the carder is stopped. This safety measure ensures that the sliver storage 5 is not filled excessively and thereby enters an uncontrolled state. The delivery of the carder is reduced to one fifth of the desired delivery if the acceptance of the fiber sliver is interfered with and the sliver storage 5 is however not yet full.

The levels of the sensors 52 and 53 are advantageously set so that sufficient reaction time for the carder 3 is available in order to prevent hindering the taking out of fiber sliver.

Figure 3:
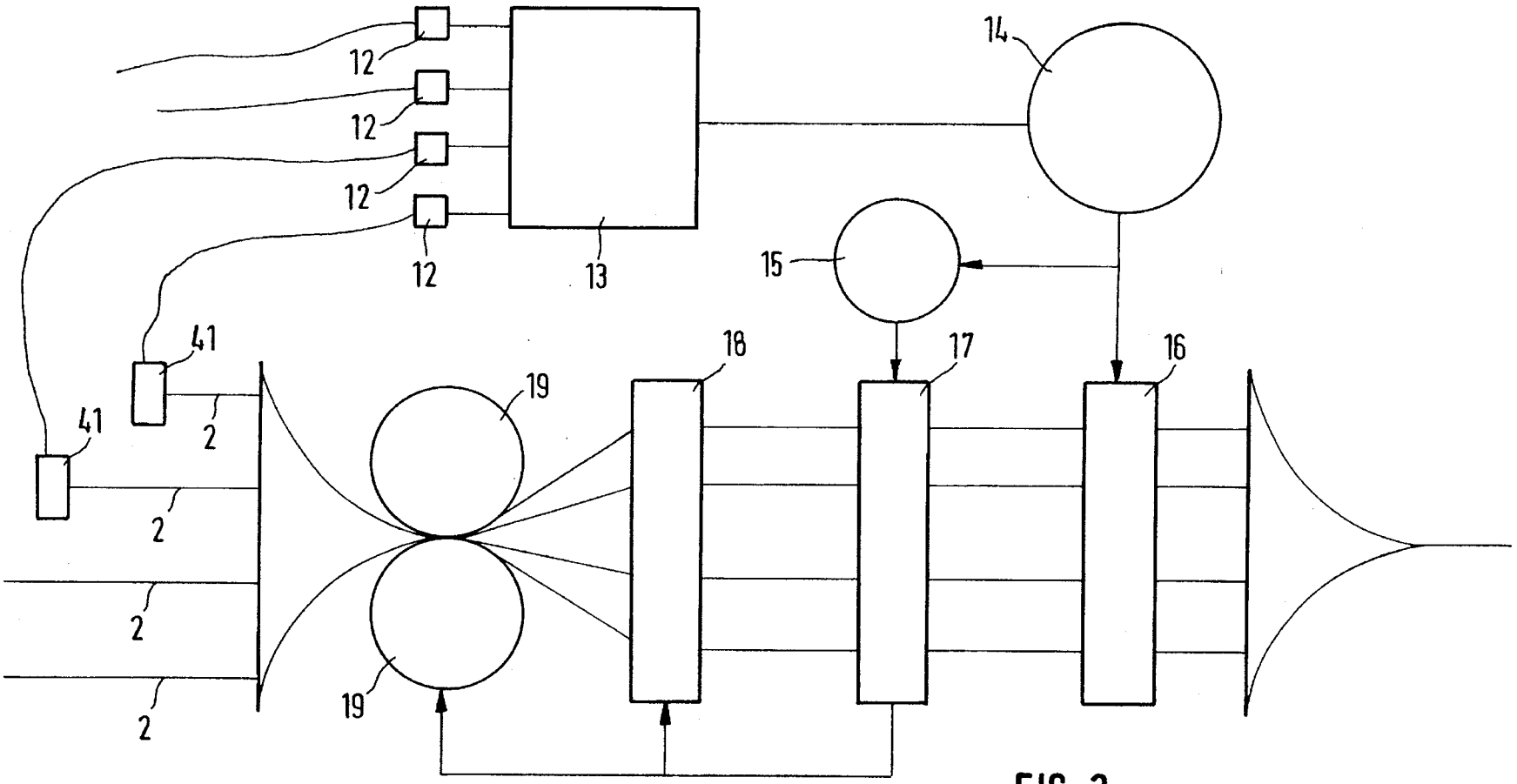
FIG. 3 shows the controls of the draw frame delivery by the sensors.

FIG. 3 shows the control of the draw frame delivery by the sensors 41. Each sensor 41 is connected to a time delay element 12. The time delay element 12 provokes a time delay of resumed acceleration to full delivery speed of the draw frame 1, in particular in case of repair of a fiber sliver breakage in an optimized embodiment it is also possible for the time delay element to cause a delayed lowering of the delivery speed when a fiber sliver breakage is detected.

The signal of the sensor 41 is transmitted to an electronic system which contains a frequency converter 13. The frequency of a main drive 14 is changed by the frequency converter 13 so that the drive 14 which is connected to a delivery roller 16 increases or reduces delivery as needed. The main drive 14 is furthermore connected to a central roller 17, to a draw-in roller 18 and to the pair of grooved rollers 19. As soon as an increase or reduction of the delivery speed is demanded, the speed of the rollers 16, 17, 18 and 19 would also be reduced. In the present autoleveller 1 a variable speed motor 15 is installed between the main drive 14 and the rollers 17, 18 and 19. The variable speed motor 15 causes precise adaptation of the drafting of the fiber sliver as a function of the thickness measured in the pair of grooved rollers 19 and of the desired thickness of the fiber sliver 2 at the output of draw frame 1. When the delivery speed is reduced by the main drive 14, the speed of the preceding rollers 17, 18 and 19 is also reduced. The variable speed motor 15 adapts itself to this reduced delivery and causes a levelling of the remaining fiber slivers. These are now drawn in more rapidly than would correspond to the corresponding delivery speed so that the desired thickness and quality of the fiber sliver is obtained at the output of the draw frame 1.

Another design of a draw frame which is not shown but is known to the person skilled in the art, consists in the fact that the rollers 16, 17, 18 and 19 individually or together in individual groups each have their own drive with this type of driving of a draw frame, the electronic system with the time delay element 12 and with the frequency converter 13 acts upon each of the different drives or drive groups. In this case the running speed, i.e. the drive of the delivery roller is reduced and the drive of the grooved roller 19 or of the draw-in roller 18 is kept constant. Thereby the draw-in speed of a fiber sliver 2 is kept uniform on average, independently of whether a fiber sliver 2 is missing or not.

In the embodiment of FIG. 3 the main drive 14 is reduced by 25% to 75% of its normal delivery speed if a fiber sliver is missing. Without corrective action, the draw-in speed of the fiber slivers 2 would also be reduced. The variable speed motor 15 however ensures that in order to maintain the desired sliver thickness at the output of the draw frame 1, the draw-in speed of the remaining three fiber slivers be increased. Due to the previous reduction of the delivery speed as well as of the draw-in speed and due to the increase of the draw-in speed by the variable speed motor 15, the draw-in speed remains on average constant at a value which would apply if all four fiber slivers 2 were to be drawn in with 100% delivery of the draw frame 1.

Figure 4:
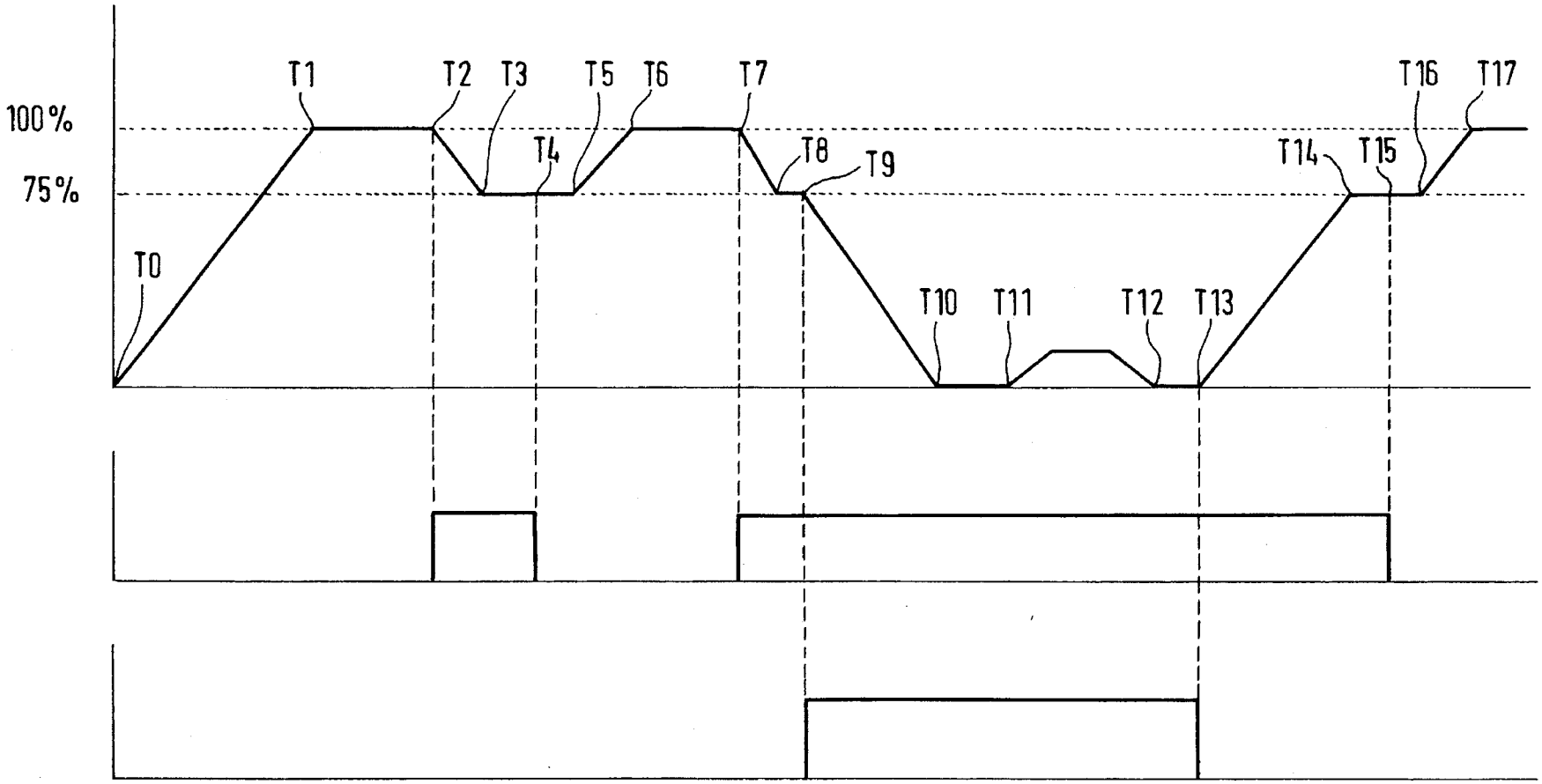
FIG. 4 shows a time diagram of different runs of a draw frame.

FIG. 4 shows a time diagram of different runs of a draw frame. At the point in time TO the draw frame 1 is switched on. The draw frame 1 accelerates continuously to the desired value of delivery. 100% of delivery is reached at point in time T1. Between T1 and T2 the draw frame produces at 100% delivery speed of a fiber sliver. At point in time T2 a sensor 41 signals a fiber sliver breakage. Thereupon and up to point in time T3 the delivery speed of the draw frame 1 is reduced to 75% of its maximum delivery speed. When the fiber sliver breakage signal of sensor 41 goes off at point in time T4, the delivery is again accelerated, after a time delay until point in time T5, to 100% delivery at point in time T6. At point in time T7 a signal of sliver breakage is again transmitted. The draw frame 1 is reduced to 75% of its desired value at point in time T8. Before this sliver brakeage is repaired, the system signals another sliver breakage at point in time T9. The draw frame 1 is then decelerated until point in time T10 to 0% of delivery. In so-called tip operation, one of the fiber slivers 2 is again inserted between points in time T11 and T12. At point in time T13 the draw frame is switched on again, so that delivery is increased to 75% of its desired value (T14). When the second signal of a sliver breakage has gone off at point in time T15, the draw frame is again accelerated to 100% of its delivery (T17) after a time delay until point in time T16.

Figure 5:
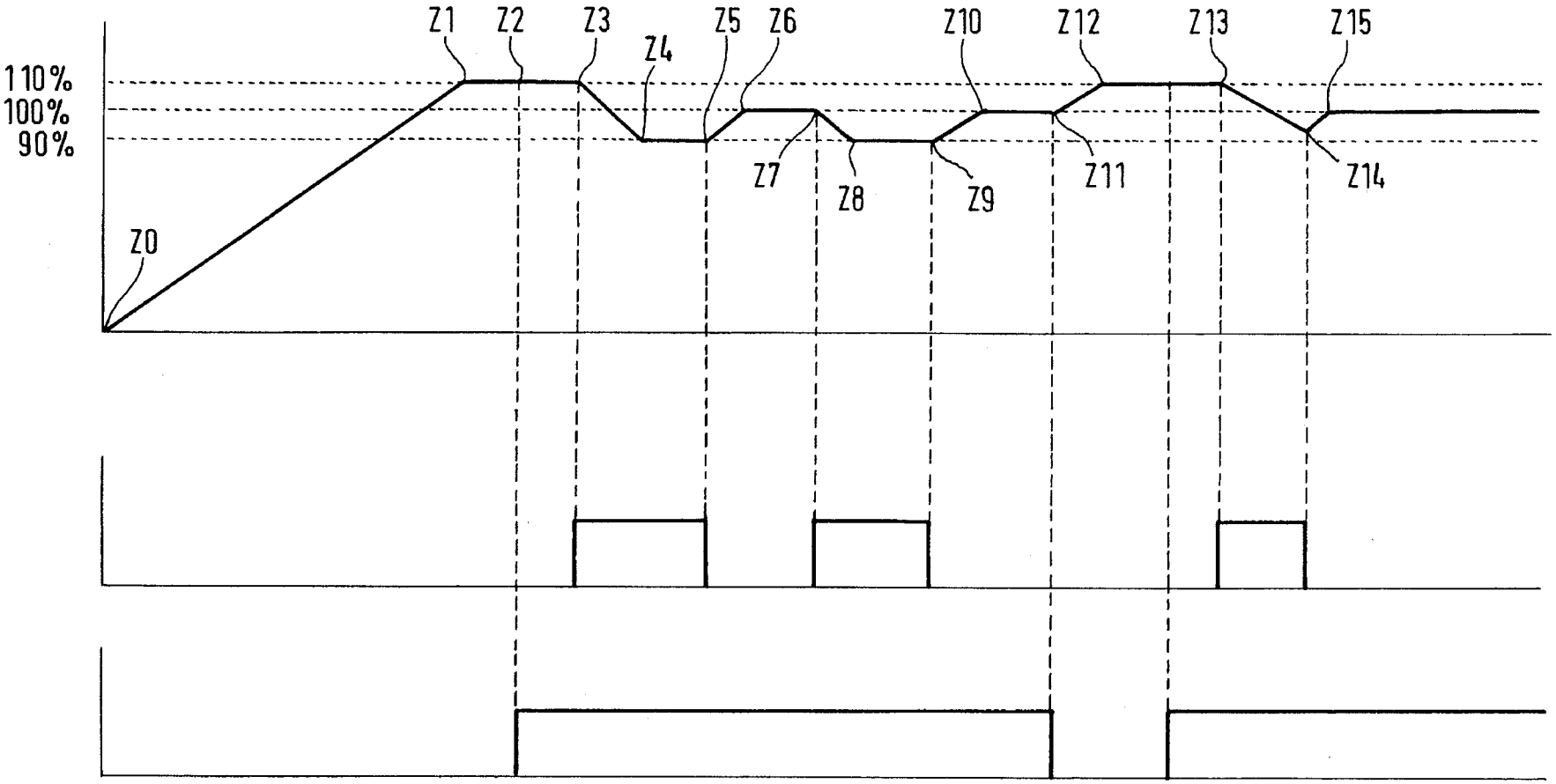
FIG. 5 shows a control diagram of a carder.

The run diagram of FIG. 5 shows the control of carder 3. The desired value of delivery of the carder 3 can be exceeded or reduced by 10%. At the beginning of production the carder is accelerated during the time Z0 to Z1 to 110% of its delivery, until the two sensors 52 and 53 in the sliver storage 5 transmit the "fiber sliver present" signal. The delivery of the carder is reduced at point in time Z3 and until point in time Z4 to 90% of delivery. After a certain time the upper sensor 53 goes off, causing the carder to be accelerated again to 100% of its desired value between Z5 and Z6. The delivery of the carder is now running between 90 and 100% of its delivery from Z7 to Z10, as a function of the upper sensor 53. Only when the lower sensor 52 also goes off at point in time Z11, is the carder again accelerated and operated at 100% until Z12, until point in time Z13 when the upper sensor 53 again indicates "fiber sliver present". If the sensor 53 goes off, as at Z14, even before 90% of delivery has been reached, the carder is immediately accelerated again to 100% (Z15). If the draw frame signals a long malfunction or a long stop, the carder is immediately decelerated to 20% of its delivery, when the upper sensor 53 does not yet signal the presence of fiber sliver. Only when this is the case is the carder stopped.

The invention is not limited to the embodiments shown as examples. In particular, other runs than those shown in FIGS. 4 and 5 also fall under the invention.

It will be apparent to those skilled in the art that various modifications and variations can be made in the present invention without departing from the scope and spirit of the invention. For example, features illustrated or described as part of one embodiment can be used in another embodiment to yield a still further embodiment. It is intended that the present invention cover such modifications and variations as come within the scope of the appended claims and their equivalents.

We claim:

1. A process for controlling operation of a textile machine draw frame wherein a plurality of fiber slivers are fed to the draw frame with the draw frame processing the fiber slivers at a predetermined desired delivery speed, said process comprising monitoring the presence of individual fiber slivers delivered to the draw frame and decreasing the delivery speed of the draw frame if any of the monitored fiber slivers is indicated as missing from being fed to the draw frame, and subsequently increasing the delivery speed of the draw frame if the respective missing fiber slivers are again indicated as being fed to the draw frame.

2. The process as in claim 1, further comprising increasing the delivery speed of the draw frame after a time delay upon indication that the respective missing fiber sliver is again being fed to the draw frame.

3. The process as in claim 2, wherein the time delay is a function of the distance between the draw frame and a feeding point of the respective missing fiber sliver.

4. The process as in claim 1, further comprising decreasing the delivery speed by a percentile amount which corresponds essentially to a percentile share of the respective missing fiber slivers with respect to the total plurality of fiber slivers.

5. The process as in claim 1, further comprising switching the draw frame off if the number of individual fiber slivers fed to the draw frame falls below a predetermined minimum number of fiber slivers.

6. The process as in claim 1, further comprising feeding the fiber slivers to the draw frame from a carder machine.

7. The process as in claim 6, further comprising feeding the fiber slivers to a storage device disposed intermediate between the carder machine and draw frame.

8. The process as in claim 7, further comprising altering a delivery speed of the carder machine between a predetermined minimum and maximum level below and above a normal operational speed as a function of the fullness state of the storage device.

9. The process as in claim 8, comprising reducing the delivery speed of the carder machine to the minimum level when the storage device is full.

10. The process as in claim 8, further comprising reducing the delivery speed of the carder machine below the predetermined minimum level in case of a malfunction of the draw frame even if the storage device is not full.

11. The process as in claim 10, comprising reducing the delivery speed of the carder machine to ⅕ of its normal operational speed in case of a malfunction of the draw frame.

12. The process a in claim 11, further comprising switching off delivery of the carder machine if the storage device is filled.

13. The process as in claim 8, further comprising monitoring the fullness state of the storage device with at least one sensor device.

14. The process as in claim 1, further comprising adjusting a draw-in speed of the fiber slivers into the draw frame as a function of changes in the delivery speed.

15. The process as in claim 14, wherein the draw frame includes an autoleveller device with a delivery device driven by a main drive and draw-in device driven by a variable speed drive, said process comprising increasing the rotational drive of the main drive and decreasing the rotational drive of the variable speed drive in the case of a missing monitored fiber sliver.

16. A textile machine draw frame, comprising:

a levelling device defining a drafting zone wherein a band of fiber slivers are combined and leveled;

a fiber sliver feeding device defining a fiber feeding area and configured to convey a plurality of individual fiber slivers to said draw frame for leveling;

a draw-in device for conveying said band of fiber slivers to said drafting zone and a delivery device having a main drive for delivering the leveled slivers from said drafting zone;

drafting rollers disposed relative said drafting zone for leveling said band of fiber slivers, and a variable speed drive controlling the drive of said drafting rollers;

a control circuit operably configured to control said main drive and said variable speed drive;

at least one fiber sliver sensor operably disposed in said fiber feeding area and in operable communication with said control circuit, said sensor signalling to said control circuit the presence or absence of at least one of said individual fiber slivers conveyed to said draw frame, and wherein said control circuit reduces the delivery speed of said delivery device by controlling the rotational speed of said main drive as a function of a decreasing number of fiber slivers being conveyed to said draw frame as signalled by said sensor.

17. The draw frame as in claim 16, further comprising a said sensor assigned for each said individual fiber silver conveyed to said draw frame.

18. The draw frame as in claim 16, wherein said control circuit further comprises a frequency converter.

19. The draw frame as in claim 18, further comprising a time delay element operably disposed between sensor and said frequency converter, said time delay element delaying an increase in delivery speed of said delivery device upon a subsequent indication from said sensor that a missing fiber sliver is again being conveyed to said draw frame.

20. The draw frame as in claim 16, wherein said feeding device further comprises a conveyor belt disposed to feed said individual fiber slivers to said draw frame.

21. The draw frame as in claim 20, wherein said sensor is disposed in an area the individual fiber slivers are fed to said conveyor belt.

22. The draw frame as in claim 16, further comprising a carder machine disposed to feed fiber slivers directly to said feeding device.

23. The draw frame as in claim 22, further comprising a sliver storage device disposed between said carder machine and said feeding device.

24. The draw frame as in claim 23, wherein said sliver storage device further comprises a sensor disposed to ascertain the fullness state of said sliver storage device.

25. The draw frame as in claim 24, further comprising a control device for controlling the delivery speed of said carder machine, said sliver storage device sensor in communication with said control device wherein said control device controls the delivery speed of said carder machine as a function of the fullness state of said sliver storage device.

26. The draw frame as in claim 16, wherein said variable speed drive is configured to increase draw-in speed of said draw-in device as a function of said main drive decreasing delivery speed of said delivery device.

* * * * *